United States Patent [19]

Samuelsson

[11] 4,309,895

[45] Jan. 12, 1982

[54] ARRANGEMENT FOR STRAIGHTENING DAMAGED VEHICLE BODIES

[75] Inventor: Mökjas J. Samuelsson, Örebro, Sweden

[73] Assignee: Josam Lastbilteknik AB, Örebro, Sweden

[21] Appl. No.: 241,207

[22] Filed: Mar. 6, 1981

Related U.S. Application Data

[63] Continuation of Ser. No. 957,284, Nov. 2, 1978.

[30] Foreign Application Priority Data

Nov. 3, 1977 [SE] Sweden ..... 7712423

[51] Int. Cl.[3] ..... B21D 1/12

[52] U.S. Cl. ..... 72/457; 72/705

[58] Field of Search ..... 72/457, 705, 389

[56] References Cited

U.S. PATENT DOCUMENTS

| | | | |
|---|---|---|---|
| 1,676,263 | 7/1928 | Hawkins | 72/705 X |
| 2,140,686 | 12/1938 | Bennett | 72/705 X |
| 3,689,030 | 9/1972 | Backus | 72/705 X |
| 3,777,537 | 12/1973 | Samuelsson et al. | 72/705 X |
| 4,068,519 | 1/1978 | Baringer | 72/426 |

FOREIGN PATENT DOCUMENTS

| | | | |
|---|---|---|---|
| 1528865 | 5/1968 | France | 72/705 |

*Primary Examiner*—Lowell A. Larson
*Attorney, Agent, or Firm*—Strimbeck, Davis & Soloway

[57] ABSTRACT

The invention relates to arrangements for straightening damaged vehicle bodies by means of straightening devices which pull and/or press, which is of the kind having a transportable alignment bar equipped with retractable wheels, said alignment bar during a straightening operation being lowered to rest on a floor joist and being fastened in a conventional way to this joist with bolt connections or the like, said alignment bar consisting of a baseplate and at least two upright wall elements attached thereto, which together form a substantialy U-shaped profile with a longitudinally extending guideway for at least one straightening assembly displaceably mounted in or on the alignment bar and comprising at least one upright beam for attachment of the straightening devices.

The invention is characterised in that the straightening assembly is constructed as a rolling carriage which is displaceably mounted in or on at least two parallel guideways formed in or on the wall elements, and in that the rolling carriage is designed to carry out longitudinal displacement movements in both directions by means of a servo-controlled operating device attached to the alignment bar and having a line of action extending longitudinally between the said wall elements.

3 Claims, 4 Drawing Figures

ARRANGEMENT FOR STRAIGHTENING DAMAGED VEHICLE BODIES

This is a continuation of application Ser. No. 957,284, filed Nov. 2, 1978.

The present invention relates to an arrangement for straightening out damaged vehicle bodies by means of pulling and/or pressing straightening means, said arrangement having a transportable alignment bar equipped with retractable wheels, said alignment bar during a straightening operation being lowered to rest on a floor joist and fastened to this joist in a conventional way with bolt connections or the like, said alignment bar being provided with a longitudinal guideway for at least one displaceably mounted straightening assembly comprising at least one upright beam for attachment of the straightening means.

For straightening a damaged vehicle body it is known to use straightening benches and straightening jigs which are installed stationary on the floor of a workshop. In this case the damaged vehicle body has to be placed on the straightening bench or in the jig and clamped firmly therein, after which mechanically-operated or servo-controlled straightening means which are part of the straightening apparatus are used to effect the straightening out of the body. This kind of stationary equipment takes up a relatively large amount of space in a workshop area, and also has a limited adaptability for carrying out dissimilar straightening operations.

With the aim of obtaining greater adaptability for different vehicle bodies and for different straightening operations, it is known to use a number of transportable straightening devices to facilitate the adaptation of a straightening appliance to a damaged part on a vehicle body. Straightening equipment of this kind generally includes an upright beam for bearing straightening means which usually are hydraulic cylinders, links and/or chains. The forces and moment which arise during a straightening operation are generally difficult to transmit to reaction force absorbing foundations or the like, and for this reason known forms of transportable straightening equipment have a limited application for straightening operations which require large amounts of force.

With a view to obtaining better absorption of force it is known to design transportable straightening devices with retractable wheels by means of which an alignment bar in the straightening device can be lowered until it rests on a workshop floor and then clamped fast to the latter by means of bolt connections which engage in joists or fixing channels which are disposed permanently in the workshop floor. In a known construction form of such a straightening device the alignment bar is designed with a longitudinally extending guideway for a displaceably mounted straightening bracket, which has the edge faces designed to form bearing surfaces against a damaged vehicle part. A straightening device of this kind is designed primarily for the horizontal straightening of a damaged vehicle chassis with the aid of servo-controlled operating means, although the equipment also includes associated means for straightening damaged body parts. However, the said associated means for straightening a vehicle body involves a complicated, cumbersome and costly manipulation of means which are integral with the straightening equipment, and affords no possibility of rapidly interchanging the straightening devices on the scale required for straightening vehicle bodies.

An object of the present invention is to design an arrangement for straightening damaged vehicle bodies by means of straightening means which pull and/or press, said arrangement being of the kind having a transportable alignment bar equipped with retractable wheels, which alignment bar during a straightening operation is lowered to rest on a floor joist and fastened in a conventional way to this joist with bolt connections or the like, said alignment bar consisting of a baseplate and at least two wall elements, which together form a substantially U-shaped profile with longitudinally extending guideway for at least one straightening assembly displaceably mounted in or on the alignment bar and comprising at least one upright beam for attachment of the straightening means.

According to the present invention, such an arrangement is characterised in that the straightening assembly is constructed as a rolling carriage which is displaceably mounted in or on at least two parallel guideways disposed in or on the wall elements, and that the rolling carriage is designed to carry out longitudinal displacement movements in both directions by means of a servo-controlled operating device attached to the alignment bar and having a line of action extending longitudinally between the said wall elements.

Straightening means for the straightening arrangement according to the invention can be constituted in a known way by chains and links or other components exerting a pulling or pressing effect on the vehicle body. The force required for carrying out this type of working operation is provided by means of the controlled displacement of the rolling carriage relative to the alignment bar, these movements being effected in a balanced way by a servo-controlled operating device attached to the alignment bar. As the operating device a suitable hydraulic assembly may be used, comprising at least one piston cylinder attached to the alignment bar, resting at one side on a transverse strut in one end of the alignment bar and at the other side on the rolling carriage, which is movably disposed in or on the alignment bar. Within the framework of the concept of the invention, the hydraulic unit may comprise either a double-acting piston cylinder arranged in the alignment bar on one side of the rolling carriage, or a single-acting piston cylinder arranged in the alignment bar on either side of the rolling carriage, where in the latter case each piston cylinder rests on one side on the rolling carriage and at the other side on a transverse strut in the respective ends of the alignment bar.

A straightening arrangement is described below in more detail as an example of the invention, with reference to the accompanying drawings in which.

Figure 1:
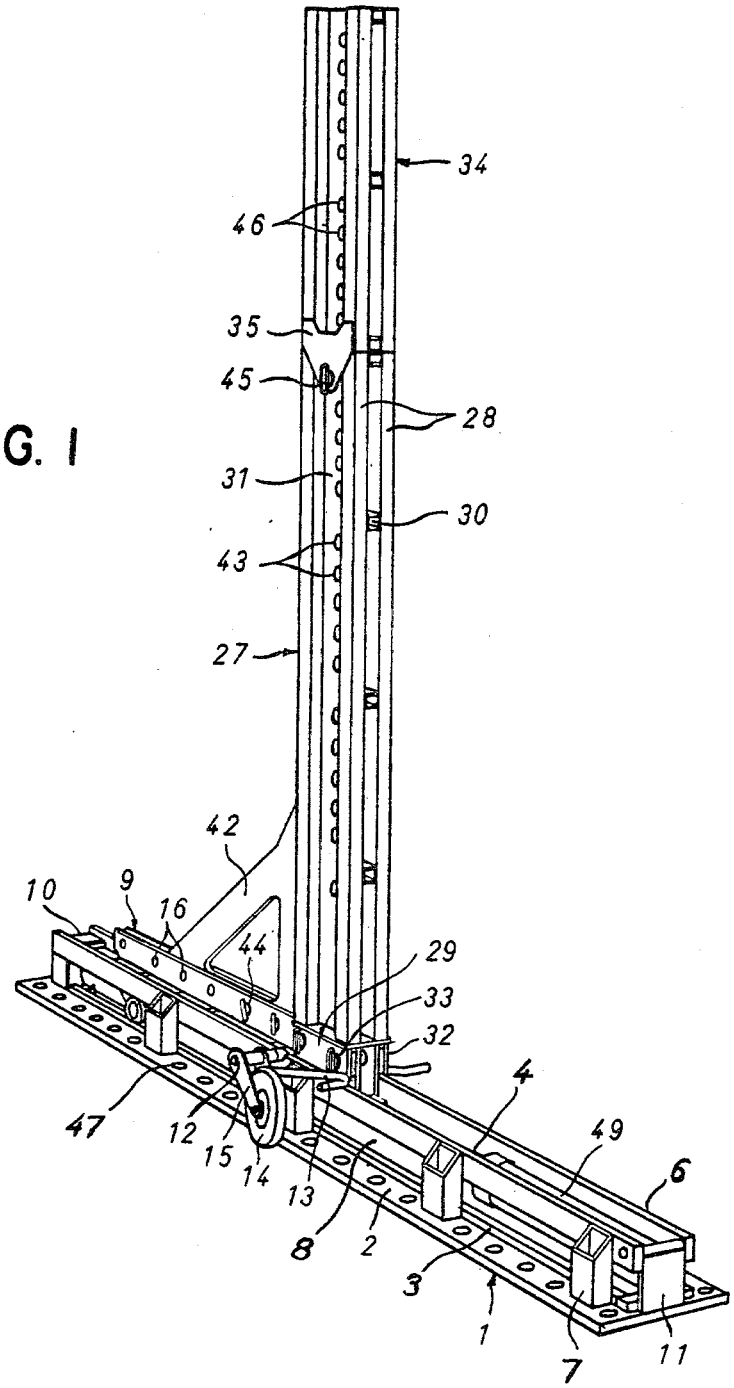
FIG. 1 is a perspective sketch of the straightening arrangement.
Figure 2:
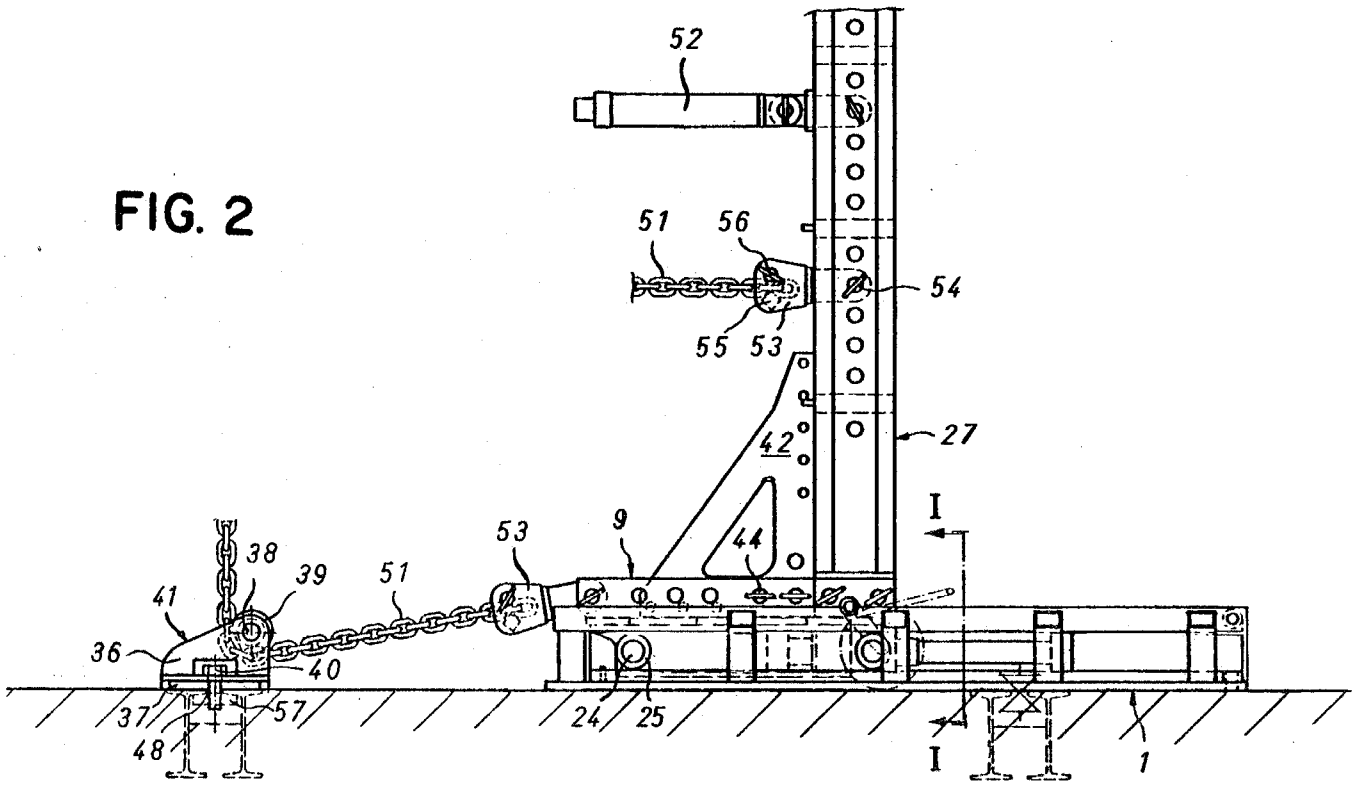
FIG. 2 is a side view of the straightening arrangement in the operating condition.
Figure 3:
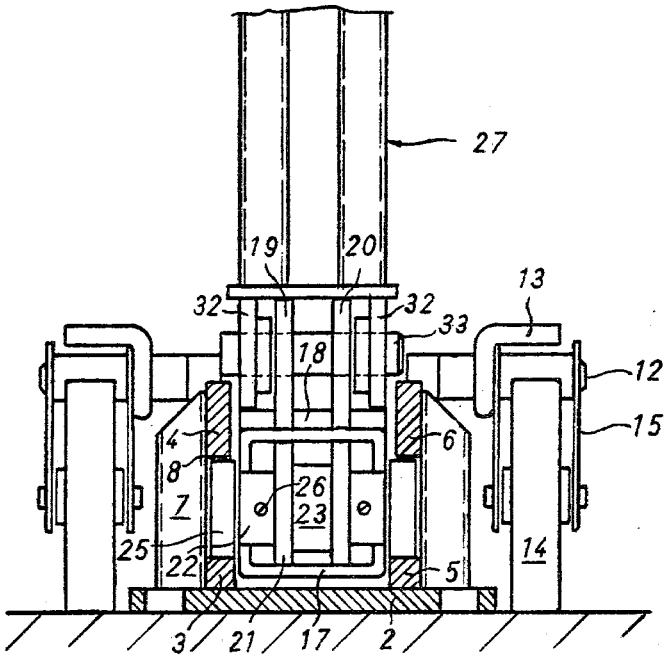
FIG. 3 is a cross-section along the line I—I in FIG. 2.
Figure 4:
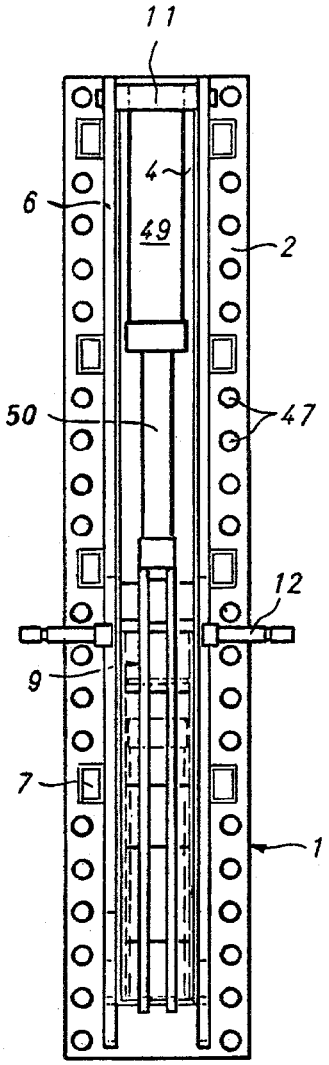
FIG. 4 illustrates with a plan view how a rolling carriage is arranged in the straightening arrangement to carry out displacement movements.

According to the Figures, the straightening arrangement shown by way of example comprises a horizontal alignment bar 1 consisting of a baseplate 2 with upright wall elements 3–6 welded rigidly directly or indirectly onto it, which together form a substantially U-shaped profile in cross-section, extending in the longitudinal direction. On the outside of the respective wall elements 3–6 there are a number of upright square tubes 7 welded together onto the baseplate 2 and the wall elements 3–6. These tubes 7 form supports and connecting elements on one side of the baseplate 2 for lower and upper wall elements 3 and 4 and, on the other side of the baseplate, for lower and upper wall elements 5 and 6. With such a construction a longitudinal opening 8 is formed on either side of the baseplate between the lower and the upper wall elements 3 and 4 and 5 and 6 respectively, which openings 8 form a guide track for a roller-mounted rolling carriage 9, which will be described in more detail later.

Outside each of the wall elements 3–6 there is a longitudinal row of evenly spaced circular holes 47 located in the baseplate 2. Via the said holes 47 the alignment bar 1 can be fastened by means of bolt connections or the like onto joists and/or in fixing channels 48 located therein, permanently disposed in the floor of a workshop.

Between the wall elements 3–6 the alignment bar 1 is closed off at one end by means of a transversely connected strut 10, and the alignment bar 1 is closed at the other end by an end-plate 11 which is removably fixed between the wall elements 3–6.

In the alignment bar 1, attached to either side is a transversely extending axle pin 12 for a pair of wheels which may be lowered, and by means of which the alignment bar 1 can take up either an upper transportation position or a lower operating position resting on the joist. Each individual wheel 14 is rotatably mounted on a fork-shaped arm 15 which is pivotably mounted on the transverse axle pin 12. With the alignment bar in the transportation position the respective arms 15 are designed to rest under the effect of the weight of the alignment bar itself against fixed stops (not shown) in the alignment bar 1, and the arms 15 are then held there on the said stops by the weight of the alignment bar 1, so that the alignment bar 1 takes up an upper position relative to the joist. By mechanical means, for example, by a foot pedal 13 fixed to the arm 15, each wheel 14 is individually moved from the transportation position, thus lowering the alignment bar 1 until it rests on the joist.

The previously-mentioned rolling carriage 9 is displaceably mounted in the alignment bar 1. This carriage is made up from a longitudinal rectangular tube 17, on which two upright wall elements 19, 20 are fixed via three transverse intermediate plates 18. The wall elements 19, 20 together form a U-shaped profile extending in the longitudinal direction. Inside the tube 17 two upright cross-plates 21 are fixed, extending longitudinally. Between the cross-plates and each inner side of the rectangular tube 17 there are hub casings 22, 23 attached firmly at at least two separate longitudinal points to form mountings for transverse axle pins 24 arranged in pairs. The axle pins 24 are locked in the conventional way with lock-screws 26 which engage radially in the hub casings 22. The said axle pins 24 bear rotatably mounted rollers 25 which are designed to be engaged from one end of the alignment bar 1 in the guide track 8 on the alignment bar 1, and provide therein a roller bearing for the rolling carriage 9.

Between the rolling carriage 9 and the transverse end strut 10 in the alignment bar 1, and also between the rolling carriage 9 and the dismountable end plate 11 in the other end of the alignment bar 1, a single-acting hydraulic piston cylinder 49 is dismountably installed, which when actuated in a manner known per se, causes the rolling carriage 9 to be displaced in the alignment bar 1. The respective pistons 50 are advantageously arranged engaging in hubs (not shown) which are provided integral with the rolling carriage 9.

In both the wall elements 19, 20 of the rolling carriage 9 there is located a row of holes 16 forming fixing points for an upright beam 27 which can be connected to the rolling carriage 9, and at least one bracket 42 to support this beam. The upright beam 27 is made from four upright rectangular tubes 28, the ends of which are rigidly connected to a rectangular baseplate 29. The tubes 28 are arranged to stand upright in the respective corners of the baseplate 29. At a number of points in the upwards direction of the upright beam 27, fixed between the rectangular tubes 28 in one transverse direction there are a number of transverse struts 30 which are of rectangular form, and in the other transverse direction longitudinal bracing plates 31 are fastened between the rectangular tubes 28, on each side of the struts 30. In the bracing plates 31 there is a longitudinal row of holes 43 which form fixing points for straightening means in the form of chains, links or hydraulic piston cylinders.

On the other side of the baseplate 29 two downwardly extending mounting plates 32 are attached, in which transverse mounting holes are located for connecting the upright beam 27 to the row of holes 16 in the rolling carriage 9 with the aid of bolts and/or pins.

With this kind of connection the upright beam 27 takes up a rigid upright position relative to the rolling carriage 9 which makes possible the connection of straightening means in a high position relative to the joist, which is a prerequisite for carrying out straightening operations on damaged body parts. To support the upright beam 27 during a straightening operation, a planar bracket 42 is attached to the rolling carriage 9 and is fixed in the row of holes 16 by means of transverse bolts or pins 44. The bracket 42 is preferably formed as a right-angled triangle with one of the two shorter sides resting on the upright beam 27. The bracket 42 is detachably mounted in the row of holes 16 and can be applied to the side of the upright beam 27 which requires support during the force effect.

If required when carrying out a straightening operation, an extension part 34 can be connected to the upper end of the upright beam 27. This is formed in the same way as the upright beam 27 and is also provided with a longitudinally extending row of transverse holes 46. The connecting end of the extension part 34 has two connecting plates 35 welded thereto, one on either longitudinal side. These plates 35 together form a projection fork which, when mounted, encompasses the upper part of the upright beam 27. In the connecting plates 35 there are transverse holes which correspond with the spacing of the holes in the upright beam 27 and make possible the dismountable attachment of the extension part 34 to the upright beam 27 by means of transverse bolts or pins 45.

Straightening means which can be connected to the upright beam 27 or to its extension part 34 lie outside the scope of the actual construction of the straightening arrangement, but to make clear the functional significance of the latter, it is necessary to touch to some extent on the straightening means which are intended for use in the practical application of the straightening arrangement according to the invention. For pressing straightening operations, braces or links (not shown) are used. Normally, straightening means with a traction effect on a vehicle body are formed by chains 51 which are attached between the vehicle body involved and the upright beam of the straightening arrangement and/or the rolling carriage 9. For fixing a chain 51 to the straightening arrangement a bow-shaped chain fastener 53 is used, being attached to the upright beam 27 and/or the rolling carriage 9 with a pin 54. Between the two arms of the chain fastener 53 a square-format brace 55 is fixed securely, and due to the clamping effect between the said brace 55 and a removable transverse pin 56 the chain 51 is attached securely to the straightening arrangement.

Both with pulling and with pressing straightening operations, the straightening is brought about by the longitudinal displacement of the rolling carriage 9 relative to the alignment bar 1. Within the framework of such straightening operations, hydraulic piston cylinders 52 can also be used as straightening means and/or counter means, so that in addition to the controlled movements of the rolling carriage, straightening can also be carried out by the individual control of one or more of the piston cylinders 52 which are acting as straightening means.

The construction of the straightening arrangement according to the invention makes possible both horizontal and also vertical straightening of damaged body parts. For the last-named purpose, a deflection roller support 41 which can be connected to a channel 48 in the floor is provided. This is made up from two vertical wall elements 36 which are securely welded to stand upright on a baseplate 37. Between the wall elements 36 a deflection roller 39 is rotatably mounted on a transverse axle 38. The deflection roller support 41 is designed to be connected to the foundations by means of a bolt 40 passing through the baseplate 37 and engaging in a permanent plate 57 movable mounted in the channel in the floor.

For a straightening operation with vertically downwards traction, a chain 51 is arranged between its fastening points on the upright beam 27 and on the vehicle body so that it runs round the said deflection roller 39. In the same way, an upper deflection roller support (not shown) can be connected to the upright beam 27 or its extension piece 34, by means of which a chain 51 can be made to exert an upwards traction effect on the body part. By a suitable choice of layout for the deflection rollers, the directions in which traction is exerted during a straightening operation can be adapted according to the effect required and desired.

The present invention is not restricted to the construction form given by way of example, but within the scope of the following claims the arrangement may be modified with the object of obtaining a smooth running, stable mounting of the rolling carriage 9 in or on the alignment bar. A stable mounting of the rolling carriage 9 makes possible straightening operations with oblique directioning of force relative to the longitudinal extension of the alignment bar 1. By this means, the straightening arrangement provides greater operational adaptability than has been known hitherto. With regard to this point, the alignment bar 1 is constructed with two parallel guide tracks 8 for the roller-mounted rolling carriage 9, thus affording the possibility of the longitudinal installation of two servo-controlled piston cylinders 49 between the said guide tracks 8 in the alignment bar 1. Also, within the scope of the following claims the rolling carriage 9 may alternatively be constructed as a sliding carriage with sliding mounting in or on longitudinal parallel guide-rails rigidly connected to the alignment bar 1.

I claim:

1. An apparatus for straightening damaged vehicle bodies, comprising a transportable elongate alignment bar having pivotally mounted wheels operable to raise and lower the alignment bar between a working position in abutment with a supporting surface and a transport position, said alignment bar defining a longitudinal center line and being adapted to be fastened to said supporting surface in said working position and comprising a base plate having at least two upright wall elements attached rigidly thereto, said base plate and said wall elements together forming a substantially U-shaped profile in cross-section defining a guideway, extending longitudinally along the longitudinal center line of the U-shaped structure, for at least one straightening unit, and at least two parallel guideways, one on each side of said axis, each defined by a longitudinal opening between a lower and an upper said upright wall element, said straightening unit comprising at least one upright beam and force generating means attached to said beam and being constructed as a rolling carriage having a longitudinally extending lower part, in the form of an elongate rectangular tube, between the wall elements, having reinforcing plates rigidly fixed therein and hub casings therein to which are mounted transverse axles which in turn support front and back pairs of rotatable rollers, disposed on the outer sides of the tube, by which the carriage is displaceably mounted in said parallel guideways, said carriage being displaceable horizontally under the influence of at least one servo-controlled means located between said upright wall elements, and said at least one servo-controlled means being attached to said alignment bar and having a line of action extending longitudinally between said wall elements.

2. Apparatus according to claim 1 wherein said rolling carriage comprises the elongate rectangular tube having at least one upright plate attached to its upper face, said plate having a longitudinal row of transverse holes located therein for attachment of said upright beam, and including at least one bracket for supporting said upright beam.

3. Apparatus according to claim 1 wherein said servo-controlled means comprises two hydraulic piston cylinders which are arranged to rest on fixed supports at either end of said alignment bar, and which, when actuated, effect displacement movement of said rolling carriage in one or the other direction.

* * * * *